US006655314B2

(12) United States Patent
Housely et al.

(10) Patent No.: US 6,655,314 B2
(45) Date of Patent: Dec. 2, 2003

(54) MAST STEP

(75) Inventors: Gary David Housely, Auckland (NZ); Andrew Boyle, Auckland (NZ); Colin Spencer Shinkfield, Auckland (NZ); James Barker, Auckland (NZ)

(73) Assignee: On Top Down Under Ltd., Auckland (NZ)

( * ) Notice: Subject to any disclaimer, the term of this patent is extended or adjusted under 35 U.S.C. 154(b) by 0 days.

(21) Appl. No.: 10/139,235

(22) Filed: May 7, 2002

(65) Prior Publication Data

US 2002/0170482 A1 Nov. 21, 2002

(51) Int. Cl.[7] ..... B63B 35/00
(52) U.S. Cl. ..... 114/347

(58) Field of Search ..... 114/89–93

(56) References Cited

U.S. PATENT DOCUMENTS 5,083,520 A * 1/1992 Bonnet ..... 114/91

* cited by examiner

*Primary Examiner*—Ed Swinehart
(74) *Attorney, Agent, or Firm*—Young & Thompson

(57) ABSTRACT

A mast step for a kayak sailing rig is provided. The mast step supports a mast relative to a deck of the kayak at a desired angle to facilitate an optimum sail shape. The step also has a convex below a surface which contacts the deck, allowing the mast to be rotated forward or aft in use, and in particular allowing the mast to be rotated from an upright position to a flat position against the deck of the kayak.

19 Claims, 3 Drawing Sheets

MAST STEP

FIELD OF THE INVENTION

This invention relates to sail apparatus, and in particular relates to a mast step for a kayak. Reference in this document to "kayak" includes kayaks and similar small watercraft such as canoes and skis.

BACKGROUND OF THE INVENTION

It is convenient when using a kayak, particularly a sea going kayak, to be able to use a sail in favourable wind conditions and thereby enable more efficient propulsion of the craft. Typically, sail rigging designs for kayaks comprise two spar or mast members which are located on a front deck of the water craft. For convenience, these members will be referred to as masts. The masts are located at an angle to each other whereby the lower ends of the masts are provided relatively close together, and the upper ends are provided relatively further apart. The sail is provided between the two masts. The masts are attached to the kayak at their lower ends by means of a rope which passes through holes in the base of each mast and is usually tied or otherwise fastened to connect on either side of the front deck of the kayak. Elastic cord material or rope holds the masts in a substantially vertically orientation relative to the water craft.

This rig set up has a significant disadvantage, being that it is difficult to adequately secure the lower end of the masts to the deck. The lower ends can be secured by means of pulling the rope very tightly between and fastening the rope between cleats, but even when adequately secured, the existing arrangement does not facilitate good sail shape. This is because the foredeck of kayaks is often angled quite steeply, and at an angle that is too steep for the optimum angle of the individual spar members. Therefore, the sail shape is sometimes compromised, and it can be difficult to lift the spar members into their vertical orientation or withdraw them to a horizontal orientation for storage or when the wind direction is not optimal for sail assisted conditions. Also, most existing kayak sail installations are designed so that they have to be individually custom made for different types of canoes or kayaks. Such sail assemblies have the disadvantage in that they are not easily adapted or interchanged amongst different craft or different types of craft.

OBJECT OF THE INVENTION

It is an object of the present invention to provide an improved sail apparatus which will at least go some way toward overcoming disadvantages associated with the existing constructions, or which will at least provide the public with a useful choice.

SUMMARY OF THE INVENTION

In one aspect the invention consists in a mast step having a body with a mast mounting means on one side thereof for supporting a mast, and a deck contacting surface on the opposite side thereof for contacting the deck of a watercraft, vessel attachment means to attach the step to the watercraft, and the mast mounting means being arranged to mount a mast at a predetermined acute angle in a plane extending in a transverse direction relative to the watercraft.

The body is preferably elongate and the vessel attachment means attach the step to the watercraft such that the elongate body extends in the transverse direction relative to the craft.

In the preferred form, the mast mounting means is arranged to provide the predetermined acute angle between the mast mounted thereon and a horizontal plane or a vertical longitudinal plane.

The deck contacting surface is substantially convex, and most preferably substantially conical.

Preferably the deck contacting surface allows a mast supported by the step to be moved between a substantially horizontal position and a substantially vertical position in a longitudinal direction while the body is attached to the watercraft by the vessel attachment means.

In the most preferred embodiment the mast mounting means are pivotally attached to the body and the mounting means comprises a spigot and the pivotal attachment allows the spigot to move in the transverse direction.

Conveniently, the vessel attachment means comprise a aperture through the body.

In a further aspect the invention consists in a mast including the mast step of the preceding statement of invention.

In another aspect the invention consists in a sail apparatus including a mast (or spar) member for supporting a sail, the base of the mast member including a support means, and the arrangement and construction being such that when the spar or mast member is oriented for use in relation to a water craft, the spar or mast member is provided at a desired angle relative to the deck of the water craft.

In a further aspect the invention consists in a sail apparatus including a mast (or spar) member for supporting a sail, the mast member having a support means at a lower end thereof, the arrangement and construction being such that the support means constrains the angle of the mast relative to the water craft while also enabling the mast to be moved between a position in which it is substantially parallel to a deck of the water craft to an upright position.

Preferably the support means has a substantially conical surface, and the support means includes an aperture therein to secure the support member to the deck.

In a preferred embodiment the support member includes a rope or webbing provided through the aperture, the rope or webbing being fastened to the watercraft.

In a further aspect the invention consists in a mast step having an outer surface which is at least partly substantially conical.

In a further aspect the invention consists in a mast step having an outer surface which is at least partly substantially galvanised.

In a further aspect the invention consists in a mast step having an outer surface which is at least partly substantially cylindrical, and most preferably is substantially conical.

In a further aspect the invention consists in a mast step assembly including a deck contacting member having a deck contacting surface which is at least partly substantially cylindrical or conical, mast base receiving means whereby a mast is able to be pivotally connected to the deck contacting member.

In a preferred embodiment the mast base receiving means include an aperture for receiving a pin whereby the mast may be pivotally connected to the deck contacting member.

The deck contacting member preferably includes at least one flange having an aperture therein, the flange aperture being adapted to receive the pin.

The assembly also preferably includes a mast base connector having a first part for receiving a base of the mast, and a further part for contacting a wall of the flange.

Preferably the mast base is substantially hollow and the first part of the mast base connector comprises a projection or spigot which is received in the hollow mast base.

The flange wall and the further part of the mast base connector preferably comprise complementary surfaces which are adapted to allow the mast to be provided at one or more substantially predetermined angles relative to the deck contacting member.

In a preferred embodiment the flange wall includes a projection and the complimentary wall of the mast base connector includes one or more recesses adapted to receive the projection to thereby allow the mast to be disposed in one or more predetermined angular orientations.

Alternatively, the flange wall includes a depression or recess and the complimentary wall of the mast base connector includes one or more projections.

Alternatively, the one or more projections or recesses are provided on the flange wall and the single projection or recess is provided on the mast base connector.

The invention may also broadly be said to consist in features, components or integers which are described in this document, either alone or in combination. To one skilled in the art to which the invention relates it will be seen that a variety of different embodiments of the invention will fall within the ambit of the appended claims.

DRAWING DESCRIPTION

One or more preferred embodiments of the invention will now be described with reference to a number of drawings, in which FIG. 1 is a perspective sketch of a first example of a mast step according to the invention FIG. 2 is a perspective sketch of a second example of a mast step according to the invention FIG. 3 is a diagrammatic partial side elevation of a kayak including the mast step of FIG. 1

DESCRIPTION OF PREFERRED EMBODIMENT

Figure 1:
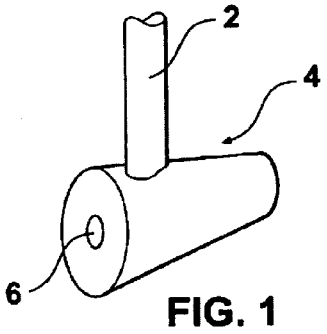

Referring to FIG. 1, the base of the mast 2 includes a mast step 4 which is provided as an elongate body for the base of the mast and is in the general form of a frustum of a cone. As will be seen further below, the mast step 4 may be generally cone shape i.e. conical, or may be provided in other shapes. A substantially central aperture 6 runs through the body of the mast step 4 to allow a rope to be provided through it as will be described further below.

Figure 2:
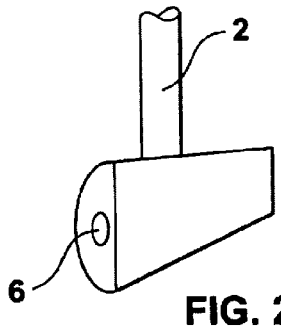

Turning to FIG. 2, an alternative form of the mast step of FIG. 1 is shown, in which the step 4 is provided in a partial general cone shape, again having a central aperture 6 that runs through it.

In use, the mast 2 will usually be constructed from a tubular metallic material such as aluminium. However, other materials may be used, such as fibreglass or other composites for example. The base of the mast 2 is placed in the mast step 4 by providing an appropriately sized aperture, for example, by drilling a hole to a desired depth into the body of the mast step 4. Alternatively a spigot may be provided extending from the body about which the hollow base of a mast may be located. Material from which the mast step 4 is constructed could be a variety of different types of material, preferably comprising plastics material which is easily moulded or otherwise shaped or formed to provide the shape that provides desired results, as will be described further below.

Figure 3:
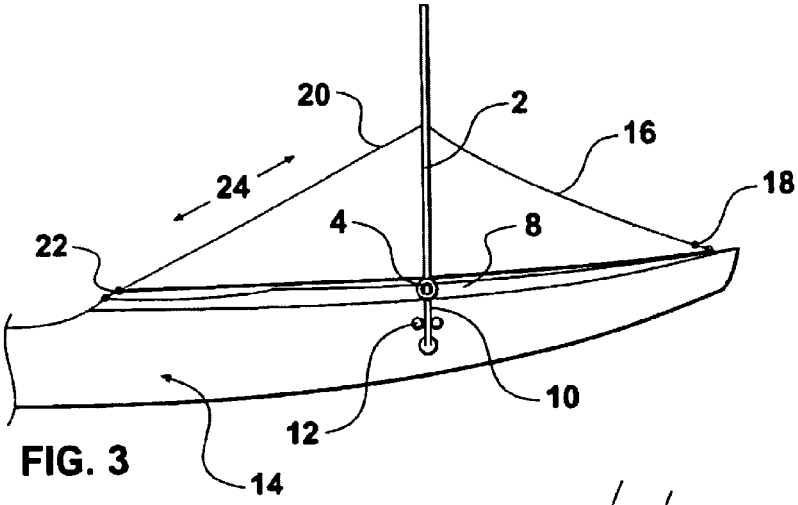

Turning now to FIG. 3, a mast assembly is shown in side elevation including the mast step of FIG. 1 on a kayak. In practice two masts are provided having similar or identical mast step arrangements as will be described further with reference to FIG. 4. However, for the purpose of general illustration of the sail arrangement which the mast step according to the invention is designed to implement, reference is made in FIG. 3 to the mast member 2 being stepped on a deck 8 of the water craft (preferably the foredeck). The mast step 4 is secured to the foredeck by means of a rope 10 passing through apertures 6. The rope is secured at the side of the foredeck or at the side of the hull of the kayak by an appropriate tie down arrangement such as the use of a tensioning cleat 12. This arrangement secures the base of the mast to the kayak 14. At some point along the length of each mast 2, stays are provided. One or more forestays 16 are provided between each mast 2 and an appropriate fastening member 18 attached to the kayak. One or more backstays 20 are provided attached to each mast 2 and a rear part of the foredeck, again using an appropriate fastener 22. The rear fastener 22 will often be provided near the cockpit of the kayak. The forestay 16 may comprise an elastic member such as a piece of bungy or shock cord, for example, which enables the mast to be held in a relatively secure upright position against the backstay 20 which will usually be held in tension.

As indicated by arrows 24, the rig is one which is able to be raised or lowered by the user in the cockpit. To lower the masts 2, the user grasps back stay 20 (or other appropriate cord or rope) to drag the masts 2 down to a flat position which is substantially parallel to the deck. To raise the masts, the user allows the elastic bungy cord to drag the masts into a substantially vertical position where they are restrained from further forward movement by backstays 20. The pair of mast steps are able to operate in tandem to provide variable sail pitch. As will be seen, the shape and configuration of the mast step member 4 greatly assists in allowing the mast 2 to rotate between the horizontal and vertical positions and beyond. Therefore, the vertical orientation of each mast in a longitudinal (i.e. fore/aft) direction is facilitated by the curved lower deck contacting surface of each step 4, and is controlled by the user using backstays 20.

Figure 4:
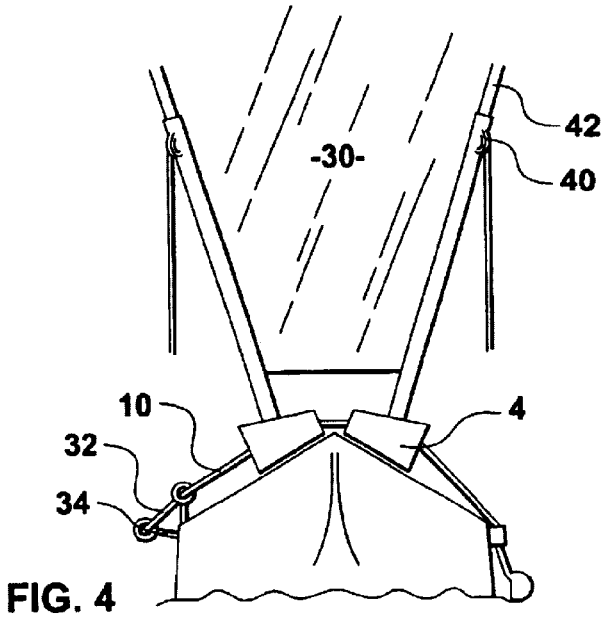
FIG. 4 is diagrammatic front elevation of the kayak of FIG. 3.

Turning now to FIG. 4, the arrangement is shown more clearly in end elevation. In particular, it will be seen that the general cone or wedge shape of the mast steps 4 assists in orienting the masts 2 correctly so that they are at the correct transverse (i.e. port/starboard) angle for improved sail shape for the sail 30. Therefore, the general shape of the mast steps 4 compensates for the effect of the steeply cambered deck as it appears to the base of the mast and provides a secure transverse support. Furthermore, the generally smoothed or curved shape of the outer surface of the mast steps 4 allow the mast 2 to be rotated back toward the cockpit in such a way that the masts tend to fold down on the deck. It will be seen that the angle of the deck does have some effect upon the general size of shape of the mast steps 4. The mast steps 4 could be cylindrical in some cases where the deck camber is reduced. Also, the shape may vary angularly, so that the masts lie parallel to the sides of the kayak in the lowered position but are splayed at the required transverse angle when the masts are in the upright position. The required transverse angle is that which provides an optimum or near optimum sail shape. As can be seen from the drawings, when viewed in a transverse plane relative to the kayak (eg when viewed in front or end elevation such as FIG. 4) the angle is acute relative to a horizontal plane. The angle is also acute relative to a vertical plane running longitudinally along the centre of the kayak.

Furthermore, it will be seen that the mast steps 4 provide a vastly improved interface between the kayak and the masts 2. The mast steps 4 lend themselves to having the central aperture 6 through which the rope 10 may be placed to secure the base of the mast assembly to the deck of the craft. In particular, as can seen from FIG. 4, one end of the rope 10 can simply be provided with a hook 32 which can be placed through an appropriate eyelet or other anchor point 34. Eyelet 34 can be easily and quickly fitted to an existing kayak, or can be easily provided on a new craft. The rope 10 is threaded through the mast steps 4, and at the other end, can be tightened across the deck by using a cleat such as a jam cleat 36 for example. Again, cleats such as cleat 36 are readily available and are easily fitted to an existing kayak, or can be provided as part of a new craft. In order to prevent the loose end of the rope 10 from becoming completely disengaged from the kayak, a knot or other enlarged ending 38 may be provided to the rope 10 to prevent the end passing back through the cleat 36.

Also, the masts 2 may be provided in a telescopic arrangement or as two pieces, joined via a spigot. Therefore in FIG. 4, the lower part of the mast member may be provided as an external tubular member 40, and the upper part 42 may be provided at a reduced overall diameter so as to slide telescopically within tube 40. An appropriate adjustment member such as a light screw, pin, shackle or the like may be provided to secure the two telescopic members relative to each other. Therefore, when the sail 30 (which may be provided with sleeves at either side to fit over or about the masts) is removed, the overall assembly may be folded up into a relatively small volume. The masts can be made of any prior art material including aluminium tubing, fibreglass or plastic tubing with a wooden or plastic doweling which connects as two sections. Also, the assembly is capable of being assembled very quickly and affixed quickly and conveniently to a kayak. Assembly is also a relatively simple matter.

Figure 5:
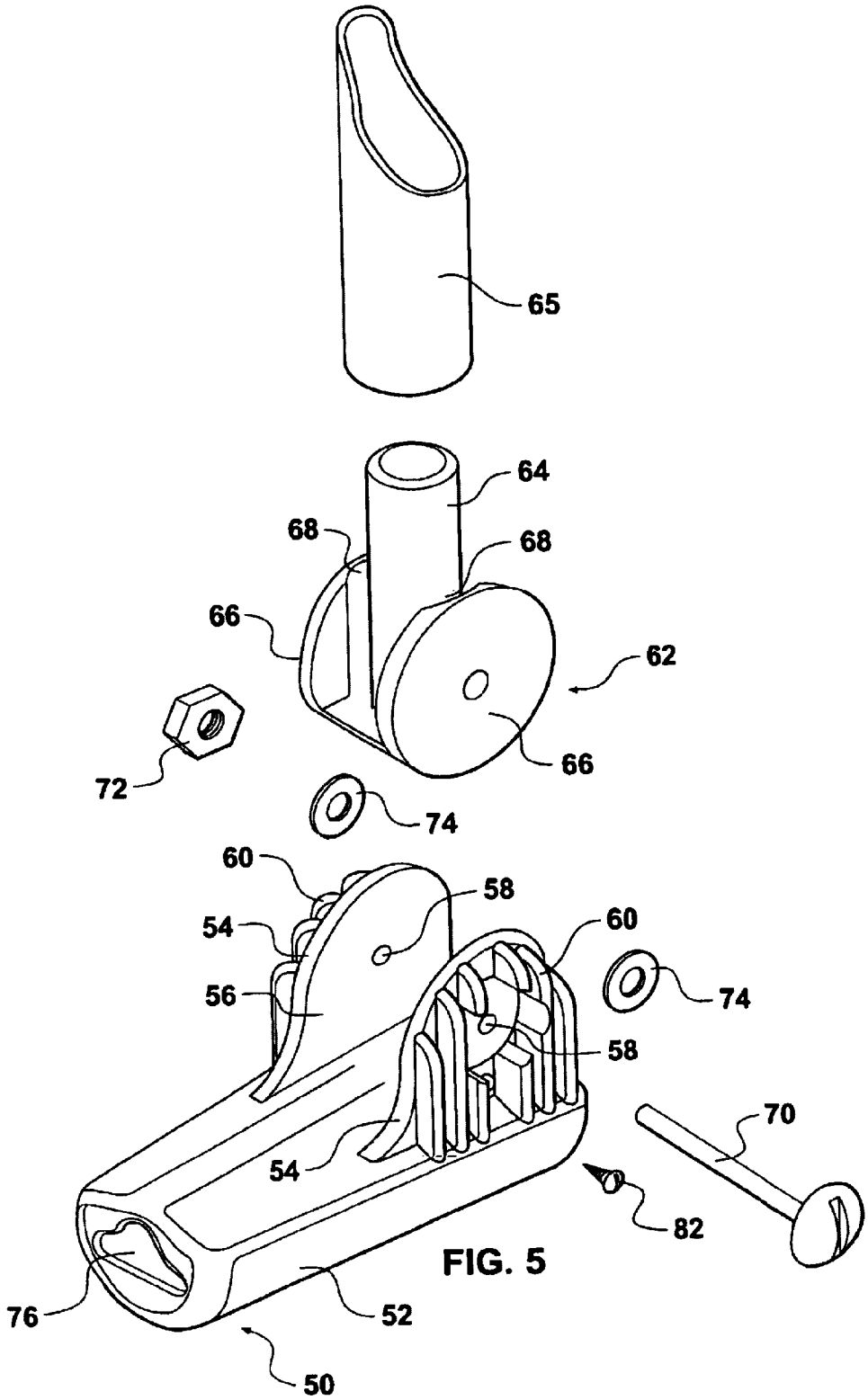
FIG. 5 is an exploded perspective view of a third example of a mast step according to the invention.
Figure 6:
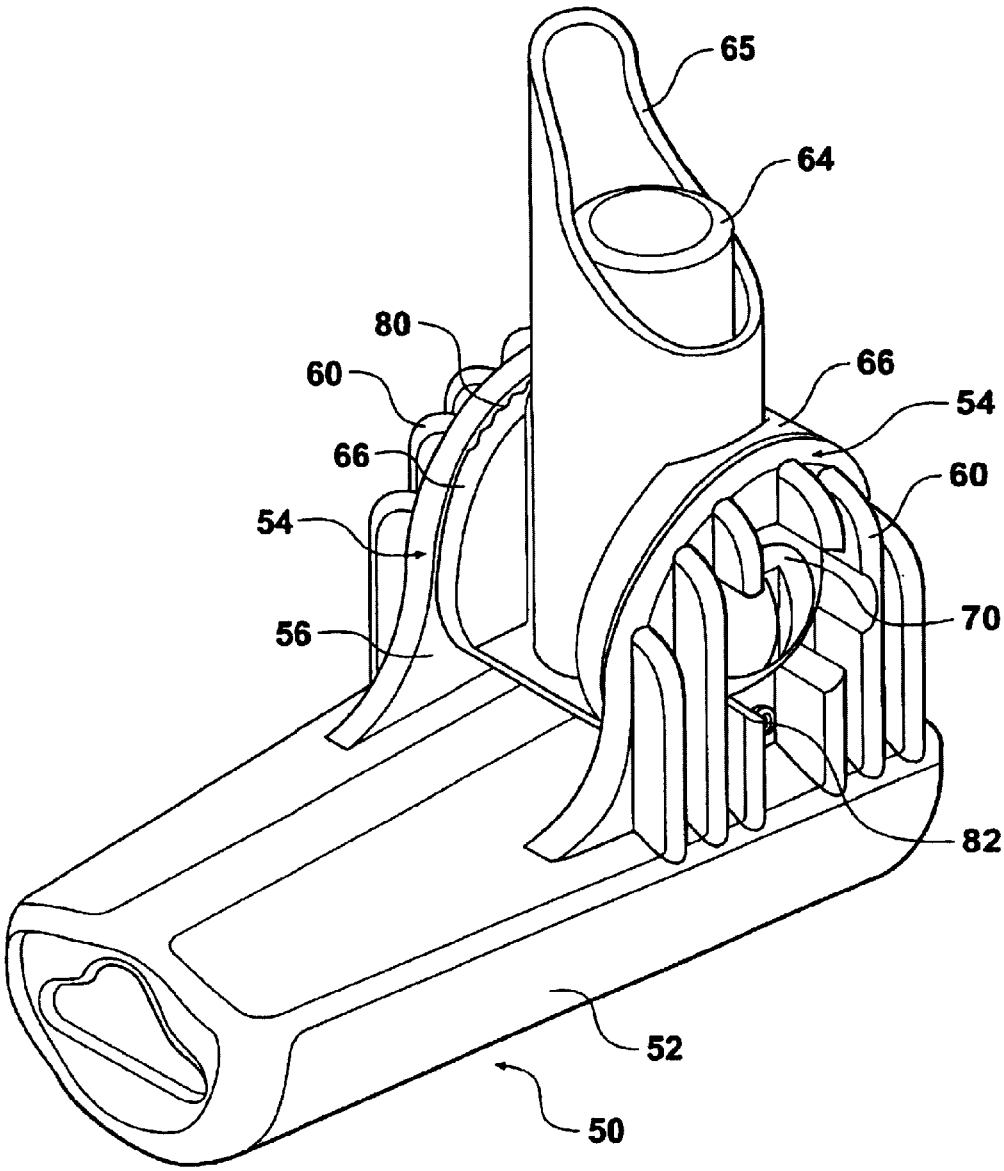
FIG. 6 is a perspective view of the assembled apparatus of FIG. 5.

Turning to FIGS. 5 and 6 a further example of sail apparatus in the form of a mast step assembly is shown. In FIG. 5, a body 50 provides the main base for the mast step and effectively replaces the mast step 4 referred to in the earlier figures. As described above, a generally curved deck contacting surface 52 is provided on the body, and this curved surface could be cylindrical but in the most preferred form is substantially conical in form. It allows the deck contacting member to roll or rotate over a part of the deck of a kayak or similar watercraft. In this way a mast may be disposed between a substantially horizontal position on the watercraft and in a substantially upright position.

The body 50 has at least one, but preferably two flanges 54 which each have an internal flange wall 56 that is preferably substantially planar and has an aperture 58 therein. Ribs 60 are provided on the outer side of each flange for additional mechanical strength. One or both of the walls 56 has one or more projections or recesses thereon which are contoured to engage with one or more corresponding or complementary projections or recesses on a pivotally mounted mast base member 62 as will be described further below.

A spigot 64 on the base 62 is received within the hollow base of mast 65. The base 62 also has one and preferably two walls 66 which in use contact walls 56 of the deck contacting member 506 The walls 66 preferably have projections or recesses to mate with those referred to above on wall 56 to provide preferred angular predetermined positions for orientation of member 62 (and therefore the mast) relative to the member 50. Spaces 68 are provided between spigot 64 and wall 66 to receive the base of the mast. Therefore to assemble the mast step assembly, the mast is placed over spigot 64, and the base 62 is placed between walls 56, then pin 70 is used to pivotally connect base 62 to member 50 and is fastened in place using nut 72. Washers 74 are also preferably provided. The pin 70 also passes through the walls of the hollow base portion of the mast so that t h e mast is securely attached to the assembly. Finally, there is an aperture 76 which is shaped to allow webbing and/or rope to pass through it to fasten the step to the deck by tensioning the webbing and/or rope as described above with reference to FIGS. 1 to 4. One alternative assembly device which may be used for webbing is to use a buckle such as that commonly known as a "LADDERLOC" type buckle along with grommet fasteners for the deck, rather than a cleat and an anchor hook. The buckles may be those commonly used with material such as that commonly referred to as "VELCRO".

Turning now to FIG. 6, the apparatus is shown in assembled view. In this view, the projections/grooves 80 that are provided on the walls 56 and 66 are shown. It will be seen to one skilled in the art that a wide variety of projections or recesses can be provided. The most preferred form is generally radial projections and recesses with one projection being provided on wall 56 and a plurality of recesses being provided on wall 66. The recesses on wall 66 are provided at predetermined dispositions so as to provide a number of preferred angular mast orientations for various sail sizes and different deck angles.

To further assist with monitoring the required angular position between base 62 and body 50, a fastener such as a self-tapping screw 82 may be disposed through one or both of flanges 54 and into the adjacent wall 66 of the base. The screw 82 thus acts as a locking pin.

Of course two of the mast step assemblies described above are required in order to provide the required sail shape as shown in FIG. 4. However, it will be seen that the apparatus could be provided such that two of the members 50 are pivotally or flexibly connected to each other in such a way as to lie across the apex of a deck of a kayak or similar watercraft. Also, the mast steps referred to herein may be provided integrally with each mast.

From the foregoing, it will be seen that the invention provides considerable advantages. In particular, it allows the orientation of masts or spars on a kayak or similar watercraft to be oriented relative to the deck of the craft to maintain a desired sail shape. Also, the sail assembly is easily raised or lowered by a user, since the mast step arrangement allows the base of the masts to rotate relative to the deck of the watercraft. The masts can be mounted on the deck of the watercraft without damaging the deck or otherwise ruining the aesthetic appearance or functionality of the craft. The sail assembly can be fitted to existing craft, or can be provided with new craft. Finally, the assembly is easily assembled and disassembled and when not in use can be reduced to a relatively small volume for convenience of handling.

What is claimed is:

1. A mast step having a body with a mast mounting means on one side thereof for supporting a mast, and a deck contacting surface on an opposite side thereof for contacting the deck of a watercraft, vessel attachment means to attach the step to the watercraft, and the mast mounting means being arranged to mount a mast at a predetermined acute angle in a plane extending in a transverse direction relative to the watercraft, wherein the deck contacting surface is substantially convex.

2. A mast step as claimed in claim 1 wherein the body is elongate.

3. A mast step as claimed in claim 2 wherein the vessel attachment means attach the step to the watercraft such that the elongate body extends in the transverse direction relative to the craft.

4. A mast step as claimed in claim 1 wherein the mast mounting means is arranged to provide the predetermined acute angle between the mast mounted thereon and a horizontal plane or a vertical longitudinal plane.

5. A mast step as claimed in claim 1 wherein the convex surface is substantially conical.

6. A mast step as claimed in claim 1 wherein the deck contacting surface allows a mast supported by the step to be moved between a substantially horizontal position and a substantially vertical position in a longitudinal direction while the body is attached to the watercraft by the vessel attachment means.

7. A mast step as claimed in claim 1 wherein the mast mounting means are pivotally attached to the body.

8. A mast step as claimed in claim 7 wherein the mounting means comprises a spigot and the pivotal attachment allows the spigot to move in the transverse direction.

9. A mast step as claimed in claim 1 wherein the vessel attachment means comprise an aperture through the body.

10. A mast including a mast step as claimed in claim 1.

11. A mast step comprising:

a body with a mast mounting means on one side thereof for supporting a mast, and a deck contacting surface on an opposite side thereof for contacting a deck of a watercraft; and a vessel attachment means to attach the mast step to the watercraft, wherein the mast mounting means is arranged to mount a mast at a predetermined acute angle in a plane extending in a transverse direction relative to the watercraft, and wherein the deck contacting surface allows the mast to be moved between a substantially horizontal position and a substantially vertical position in a longitudinal direction while the body is attached to the watercraft by the vessel attachment means.

12. A mast step as provided in claim 11, wherein the body is elongate and wherein the vessel attachment means attach the step to the watercraft such that the elongate body extends in the transverse direction relative to the watercraft.

13. The mast step as claimed in claim 11, wherein the mast contacting means are arranged to provide the predetermined acute angle between the mast mounted thereon and a horizontal plane.

14. The mast step as claimed in claim 11, wherein the mast contacting means are pivotably attached to the body.

15. The mast step as claimed in claim 14, wherein the mounting means comprises a projection, said projection being insertable into a tubular hollow portion of the mast, said projection being pivotable in the transverse direction.

16. The mast step as claimed in claim 11, wherein the vessel attachment means comprises an aperture through the body.

17. A mast step comprising:

a body having opposing first and second surfaces;

a mast mounting member connected to said first surface;

a vessel attachment member for attaching the mast step to a craft, so that said second surface contacts the craft, wherein said body is rotatably movable so that said first surface is movable between a first position substantially perpendicular to a longitudinal axis of said craft and a second position substantially parallel to said longitudinal axis, said second surface contacting said craft at a plurality of positions between said first and second positions.

18. The mast step as claimed in claim 17, wherein the vessel attachment member is adjustable with respect to an attachment member on the vessel.

19. The mast step as claimed in claim 17, further comprising two mast steps, each said mast mounting member being pivotable about a transverse axis of said craft.

* * * * *